US005332123A

United States Patent [19]

Färber et al.

[11] Patent Number: 5,332,123

[45] Date of Patent: Jul. 26, 1994

[54] DEVICE FOR THE MEASURED DISPENSING OF LIQUIDS OUT OF A STORAGE CONTAINER AND SYNCHRONOUS MIXING WITH A DILUENT

[75] Inventors: Karlheinz Färber, Giengen/Brenz; Walter Eichler, Gentetter; Anton Deininger, Bachhagel; Heinz-Werner Giefer, Bergenweiler/Brenz; Alfred Raab, Attenhofen, all of Fed. Rep. of Germany

[73] Assignees: The Coca-Cola Company, Atlanta, Ga.; Bosch-Siemens Hausgerate GmbH, Fed. Rep. of Germany

[21] Appl. No.: 948,305

[22] Filed: Sep. 22, 1992

Related U.S. Application Data

[63] Continuation-in-part of Ser. No. 900,797, Jun. 22, 1992, abandoned.

[51] Int. Cl.[5] ..... B67D 5/56

[52] U.S. Cl. ..... 222/129.4; 222/135; 222/640

[58] Field of Search ..... 222/129.1, 129.2, 129.3, 222/129.4, 135, 136, 306, 640, 641

[56] References Cited

U.S. PATENT DOCUMENTS

| | | | |
|---|---|---|---|
| 3,401,639 | 9/1968 | Schwetferger et al. | 222/129.4 X |
| 4,037,757 | 7/1977 | Green | 222/129.2 |
| 4,124,146 | 11/1978 | Sealfon | 222/641 |
| 4,884,720 | 12/1989 | Whigham et al. | 222/54 |
| 4,890,774 | 1/1990 | Poore | 222/640 |
| 4,938,396 | 7/1990 | Shannon | 222/129.1 X |
| 4,955,509 | 9/1990 | Nevill | 222/129.4 |
| 4,966,306 | 10/1990 | Credle, Jr. et al. | 222/129.2 X |
| 4,976,546 | 12/1990 | Beattie | 222/135 X |
| 5,012,955 | 5/1991 | Shannon | 222/641 X |
| 5,058,780 | 10/1991 | Plester et al. | 222/321 |
| 5,060,824 | 10/1991 | Credle, Jr. | 222/129.2 X |

FOREIGN PATENT DOCUMENTS

| | | | |
|---|---|---|---|
| 0104447 | 4/1984 | European Pat. Off. | 222/640 |

*Primary Examiner*—Andres Kashnikow
*Assistant Examiner*—Joseph A. Kaufman
*Attorney, Agent, or Firm*—Birch, Stewart, Kolasch & Birch

[57] ABSTRACT

In a post-mix beverage dispenser system including beverage concentrate containers and a storage tank for the supply of diluent through an electromagnetically actuated valve, the beverage concentrate is provided to the mixing station in a series of individual pulsed portions by a reciprocating piston pump coupled to the containers for the beverage concentrate. An electromechanical control circuit is also provided for rhythmically opening and closing the electromagnetic valve for a pulsed supply of diluent in synchronism with the pulsed delivery of the beverage concentrate for providing a mixture of precise proportions.

2 Claims, 5 Drawing Sheets

DEVICE FOR THE MEASURED DISPENSING OF LIQUIDS OUT OF A STORAGE CONTAINER AND SYNCHRONOUS MIXING WITH A DILUENT

This application is a continuation-in-part of application Ser. No. 07/900,797 filed on Jun. 22, 1992 now abandoned, the entire contents of which are hereby incorporated by reference.

This application is also assigned to the same assignee as the present application.

BACKGROUND OF THE INVENTION

The present invention relates to an apparatus for the measured dispensing of liquids from a storage container, particularly for the measured dispensing of beverage concentrates in an automatic beverage dispenser, where drinks can be prepared by mixing a diluent, e.g. carbonated water, and at least one beverage concentrate stored in a storage tank. More specifically, the present invention relates to an apparatus for dispensing consecutive, individual portions of concentrate from the storage container synchronously with the opening and closing of a delivery valve through which the diluent is supplied to a mixing station in the beverage dispenser.

Such an apparatus is preferably able to make available for the mixing process, in automatic beverage dispensers in which carbonated water is mixed with beverage concentrates into a soft drink, the beverage concentrates from one of the two storage containers in a volume-regulated amount and the carbonated water as the other liquid. The mix proportions attained in such automatic beverage dispensers of beverage concentrates to carbonated water in the finished soft drink should if possible be so precise that the drink prepared in the automatic beverage dispenser will if possible attain the standard of comparable pre-mix drinks on the market in bottles or cans. In order to be able to produce the precision in the mix proportions, and hence the high quality of the beverage, it is necessary to be able to dispense both the beverage concentrates and the carbonated water with corresponding high precision as far as volume is concerned.

For placement into automatic beverage dispensers to dispense beverage concentrates, dosage chamber devices have been developed. These dosage chamber devices are attached to a storage tank with the dispensing mouth at the bottom. By means of a magnet system a control valve inside this dosage chamber device is raised from a lower position, where the outlet port of the chamber is closed, to a higher position, where the inlet port of the chamber is closed, so that the contents of the dosage chamber can flow out by force of gravity. However, the dosage chamber space can become filled with air. When the control valve resumes its lower position, the beverage concentrate stored in the storage tank ends up in the dosage chamber by force of gravity, and any air in the dosage chamber will flow into the storage tank. The control force needed to activate the control valve is correspondingly slight, since no actual propulsion force need be produced. These are storage tanks with either rigid or flexible walls. In both cases there is an exchange of volume through extracting beverage concentrates by the use of air.

The above-described dosage chamber devices are very difficult to reduce in size due to technical realities relating to size and the volume they dispense. They are above all suited for dispensing concentrates for 1/10 drink portion units. For smaller amounts greater problems with functioning and dosage precision are presented. So these known dosage chamber dispensers make it difficult to dispense individual drinks on demand.

For making available carbonated water for mixing with beverage concentrates devices have been developed, water prepared and stored under high pressure in a carbonator can be dispensed in a flow-through regulated way by a flow-volume regulator and also be a volume-regulating timed valve.

It is also possible to deliver beverage concentrates from the storage container to the mixing area for mixing and preparation of beverages by using a piston pump system. Piston pump systems for this purpose require, compared to the known dosage chamber dispensers, a higher drive output, but they offer the possibility to portion out the beverage concentrates in essentially smaller individual amounts and with higher dispensing frequency, so that drinks can be mixed in individual, fixed amounts on a practically continuous basis.

The measures required to deliver beverage concentrates on one hand and carbonated water on the other for the purpose of making them into a drink have been chosen and optimized according to the particular requirements and conditions. But since these measures necessarily vary and present peculiar characteristics, care must be taken that these varying characteristics do not have any disadvantageous consequences for the intended mix proportions of the ready drink, and indeed are independent of what amount of ready drink is being mixed and prepared.

Considering these facts, the present invention provides such a device which, with the least amount of effort, will ensure that a particular mix relationship of two liquids, syrup concentrate and carbonated water, brought together at a mixing station, will remain very precise and repeatable over a long period of use independently of the particular dispensing volumes.

SUMMARY OF THE INVENTION

A device that meets these requirements is, according to this invention, characterized by the fact that the timed dispensing valve that regulates the delivery of the flow-through volume regulated liquid diluent can be selectively adjusted over a plurality of consecutive equal length work cycles and which works in synchronism with the volume dosing device of the beverage concentrate.

According to the operation of the volume-dosing device for the concentrate timed action of the delivery valve for the addition of the flow-through regulated liquid diluent leads to the fact that, according to the characteristics of this invention, the two liquids that are to be mixed comprise pulsed quantities of both liquids with the accompanying result that the mix proportions will remain precise and repeatable. For example, it has turned out that when liquids are dispensed by regulating the flow-through of diluent, during the opening and closing of the timed delivery valve, as opposed to continuous flow-through regulated delivery, different conditions develop. These may contribute to rendering the desired mix proportions imprecise. Clearly it is determined to multiply these influences by making the delivery flow of diluent rhythmic. But since these influences appear to have almost the same effect at each input and output occasion, these influences are then also controllable, if they are multiple. The present invention, however, ensures that these irregular but controllable influences have a fixed connection with the dispensed total volumes and hence are to the same degree controllable, independent of the particular dispensed volumes.

In a preferred embodiment of the present invention the volume-dosing device is a pulsed system, which can deliver both liquids, e.g. in automatic beverage dispensers the beverage concentrate, in consecutive, individual, small doses or pulses. In this connection, the timed delivery valve of the supply of diluent is also pulsed along with the beverage concentrate and activated by the drive mechanism for the volume-dosing device. The activation is purely mechanical. But it is also possible to make this device in such a way that a control contact that can be influenced by the drive mechanism of the volume-dosing device runs the electromagnet that activates the rhythmic timed delivery valve.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF THE PREFERRED EMBODIMENTS

Figure 1:
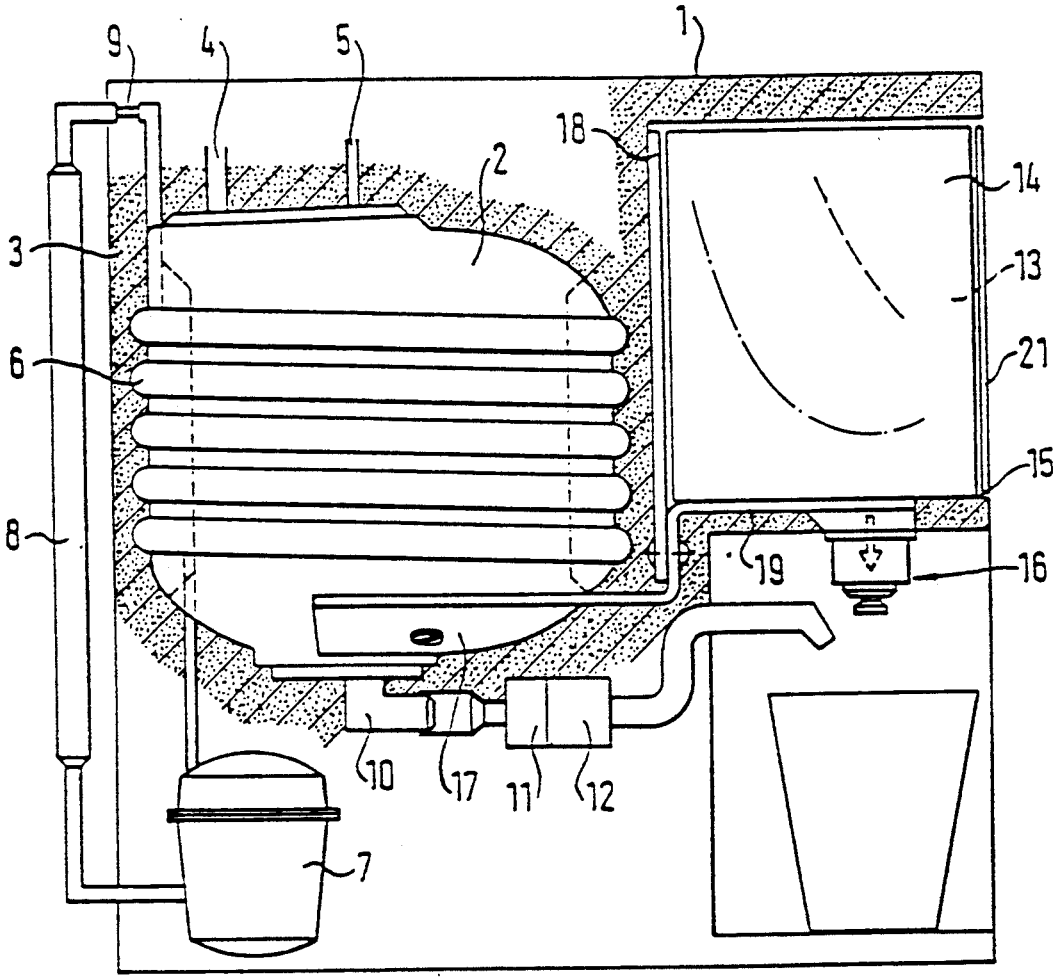
FIG. 1 illustrates a beverage dispenser including a carbonator for supplying carbonated water and a storage tank with a beverage concentrate for mixing into a post-mix drink.

In the simplified and diagrammatic illustration of FIG. 1, we see that in a device casing 1 of an automatic beverage dispenser, there is a carbonator 2 which is heat-isolated by an isolation shell. Through an inlet pipe 4 this carbonator 2 is in the usual way provided with water, as needed, from a water source, and by way of a feed line 5, CO2 in the form of gas. Inside this carbonator 2, the provided water is mixed with the provided CO2 into carbonated water. The carbonator is cooled by cooling pipes 6, which together with a compressor 7, a condenser line 8, and a throttle 9, form a compressor-cooling machine. In the lower part of the carbonator 2 there is an outlet 10 for the carbonated water. According to the regulating activity of a selectively adjustable flow-through volume regulator 11 and connected electromagnetic outlet valve 12, carbonated water will be delivered, to a mixing area, to which also beverage concentrate 13 is supplied, for producing and preparing a post-mix soft drink.

The beverage concentrate 13 is stored in a container 14, which is inserted inside a storage space 15 in the dispenser casing 1. Via a drive system the beverage concentrate 13 is dispensed through a dosing system 16, which is an integral component of the container 14, and is mixed with the carbonated water to produce a soft drink.

In the lower container portion of the carbonator 2 in the area of the outlet 10 for the carbonated water there is a heat-conducting element 17 flanged onto its surface, and extensions 18 and 19 of the storage space 15, lead to where the container 14 for the beverage concentrate 13 is disposed in order to cool it.

The device of the present invention is part of an automatic beverage dispenser for the delivery of beverage concentrates which, together with carbonated water or other diluents, will be mixed into drinks. In automatic beverage dispenser beverage concentrates are stored storage tanks 13, and each are connected to a piston pump system 16, through which the desired beverage concentrate is obtainable in the right size doses. This type of system and storage tank is more fully disclosed in prior U.S. Pat. No. 5,058,780, entitled, "Dosing System For An Unvented Container", issued to George Plester et al on Oct. 22, 1991.

Figure 2:
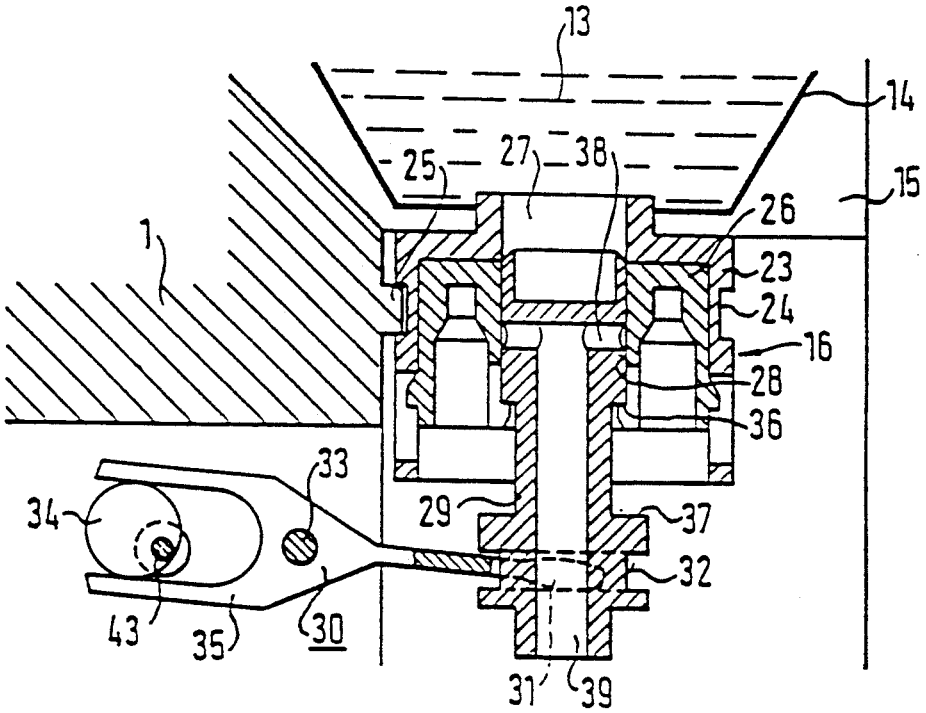
FIG. 2 is a side elevational view in cross-section of a piston pump system with a cam drive inserted in a casing of the dispenser of FIG. 1 for the delivery of beverage concentrate.

FIG. 2 illustrates the construction of the delivery device. This delivery device is a piston pump system and consists of a pump casing 23, which can be stored and inserted into the delivery area of an automatic beverage dispenser inside its casing or cabinet 1 from the front. For this purpose, the pump casing 23 includes a circular groove 24 into which a yoke-shaped protrusion 25 of the device casing 1 mates. Inside this pump casing 23, is an accelerator (pump) piston 26 axially disposed between impact points 36, 37 so that it can move. These impact points 36, 37 determine the piston lift, which determines the transport volume of the outflowing beverage concentrate every work cycle. An inflow opening 27 in the pump casing 23 which extends to the storage tank 13 and a central bore 28 in the accelerator piston 26 are concentrically arranged, so that inside, the shaft of a control piston 29 can be axially inserted so that it can move. The axial movement between the control piston 29 and accelerator piston 26 is again limited by impact points 36, 37. The control piston 29 is reciprocated by a pivot lever 30 that engages with a fork in one lever end 31 in a groove 32 of the control piston 29. The pivot lever 30 is disposed in the dispenser casing on fixed axis 33 and is drive longitudinally by an eccentric drive cam 34 encircled by a forklike portion of another lever arm 35 of the lever 30.

If the cam 34 moves out of the position illustrated in FIG. 1, the pump piston 26 will be moved down toward impact area 36, so that beverage concentrate from the storage tank 13 is sucked up through the inflow opening 27 into the piston pump system 16. As the cam 34 is further moved, first the upper shaft of the control piston 29 gets into the area of the intake opening 27 and closes if off. As the control piston 29 continues to move up, the impact areas 37 between control piston 29 and accelerator piston 26 engage, so that accelerator piston 26 is now moved up with the control piston 29. Thereby the originally sucked up beverage concentrate amount will be transported over side channels 38 in control piston 29 to a central delivery channel 39 inside control piston 29. From this central delivery channel 39, the beverage concentrate discharges into an area where it will be mixed into a drink with carbonated water also delivered there. It is possible to have as many work cycles as one wishes to follow immediately upon each other so that the delivery amount of the individual work cycles as well as the totality of work cycles can be very precisely determined or arranged. It should be understood that the structure and operation of the piston pump of FIG. 2 is also fully disclosed in the aforementioned U.S. Pat. No. 5,058,780.

Figure 3:
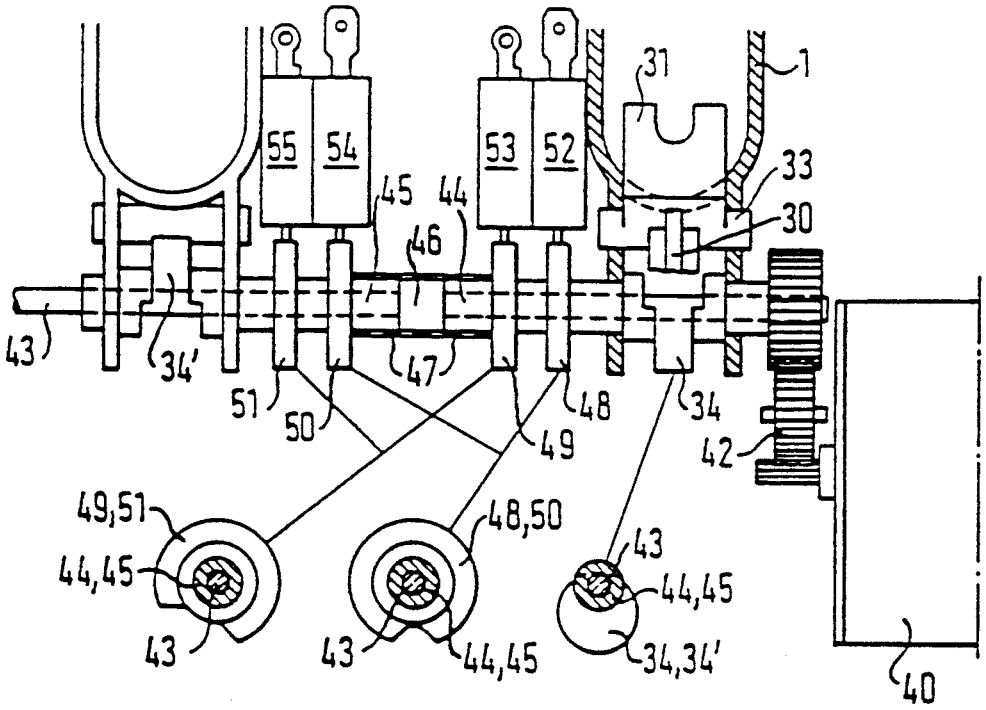
FIG. 3 is a cam drive system for two side-by-side piston pump systems of the type illustrated in FIG. 2 and for actuating the delivery valve for the carbonated water stored in the carbonator of FIG. 1.

FIG. 3 shows in a simpler and more schematic view a drive for two side-by-side piston pump systems 16, according to FIG. 2. An electric motor 40, indeed a reversible electric motor, is placed over a cog wheel drive 42 with a drive shaft 43 connected to the drive. Through appropriate electrical wiring, the electric motor 40 can rotate in both directions and hence also drive the drive shaft 43 in both directions. This drive shaft 43 selectively drives one of two hollow shafts 44 and 45 through which is passes. Hollow shafts 44, 45 are disposed so they can turn in the drive casing 1 and carry a cam 34 or 34', respectively. The shaft 43 carries on a flange area 46 thereof a twisting spring band 47, which selectively engages either hollow shaft 44 or 45 for opposite directions of rotation of shaft 23. This twisting spring band 47 is rigidly connected to the flange area 46 of the drive shaft 23 and concentrically surrounds adjacent portions of the two hollow shafts 44 and 45 respectively as a free-wheel coupling (a free wheeling clutch). The selective coupling or decoupling of the flange area 46 to shafts 44 or 45 is dependent on the twisting direction of the twisting band coupling 47. Therefore, depending on the direction of rotation of the reversible electric motor and drive shaft 43, either hollow shaft 44 with cam 34 and with it drive lever 30 rotates, while drive shaft 45 is, disconnected (uncoupled), or hollow shaft 45 with its cam 34 rotates while hollow shaft 44 is uncoupled and stationary. Hence with the electronically or electrically regulated direction of rotation of the reversible electric motor 40, the selection of the piston pump system to select a particular one of the two stored beverage concentrate flavors is possible.

Onto hollow shaft 44, as onto hollow shaft 45, two control cams 48, 49 and 50, 51 respectively have been fastened. These control cams actuate switches 52, 53 and 54, 55. The control cams 48 and 50 actuate switches 52 and 54 in circuit with the reversible electric motor 40, so that after a particular work phase, it rotates a distance such that the particular hollow shaft 44 or 45 being driven by its cam 34 or 34' is returned to a definite rest position. Hence this ensures that a particular piston pump system 16 completes full work cycles. The control cams 49 and 51 actuate switches 53 and 55 arranged in an electromagnetic system of FIGS. 4 and 5 that activates a delivery valve for the carbonated water to be mixed with the beverage concentrates. In automatic beverage dispensers this carbonated water is stored under high pressure and usually cooled in a carbonator such as illustrated in FIG. 1. When the delivery valve 12 connected to a pressure regulator 11 is opened, carbonated water is delivered by the excess pressure in the carbonator to the mixing area for mixing with carbonator the particular beverage concentrate. However, as will be shown, the delivery valve 12 has an inherent turn-on and turn-off characteristic. Hence each work cycle will furnish a definite amount of beverage concentrate determined by piston pump system 16 and a quantified amount of carbonated water.

Figure 4:
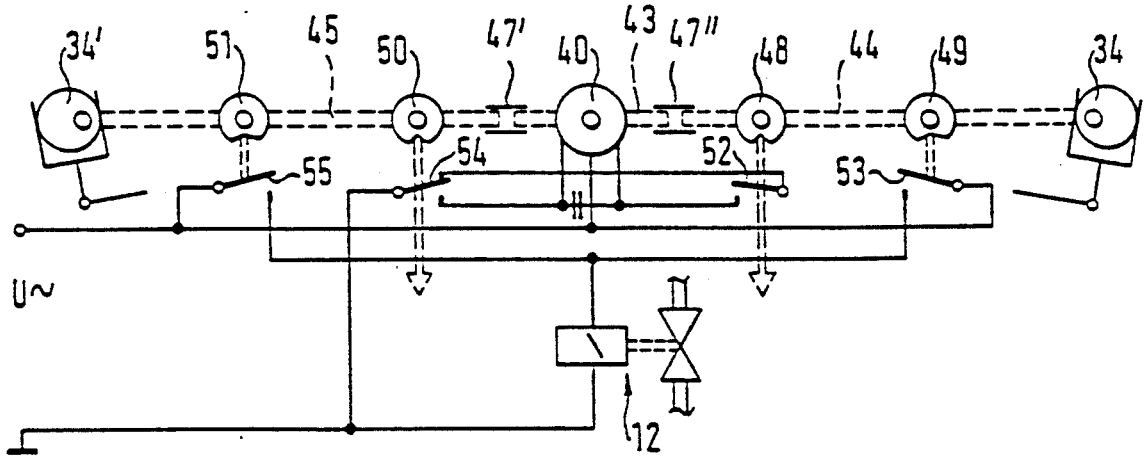
FIG. 4 is an electrical circuit schematic illustrating the electromechanical interaction of the cams and electrical switches in FIG. 3.
Figure 6:
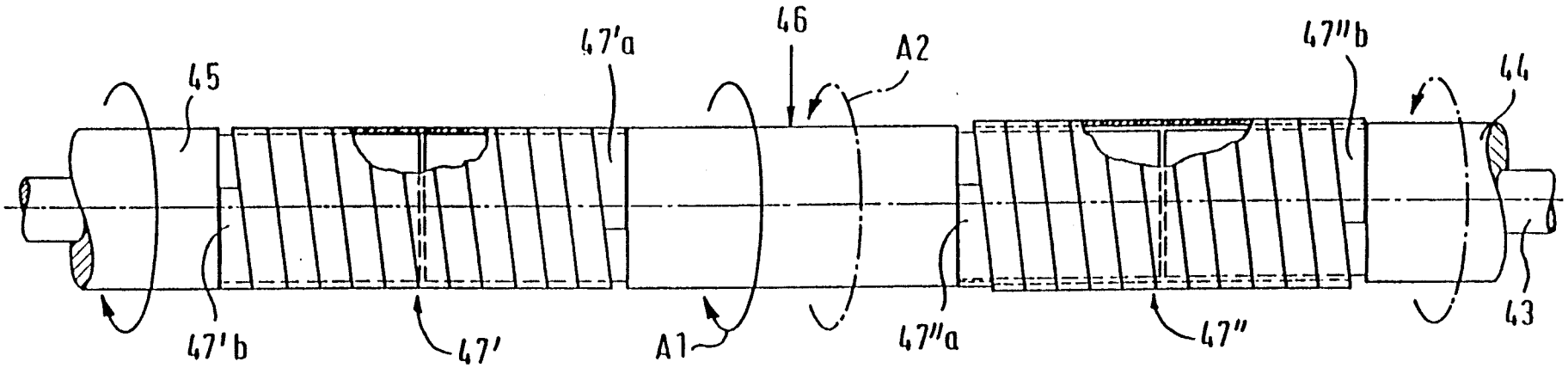
FIG. 6 is an enlarged view of a wrap around band coupling assembly of the cam drive system of FIG. 3.

The wrap around band coupling 47 with the flange area 46 and the hollow shafts 44, 45 are shown more detailed in FIG. 6 in which both partial sections 47' and 47'' of the wrap-around band coupling 47 for a better understanding are separated—in contrast to the assembly shown in FIG. 2. In FIGS. 3 and 4 is shown a separated assembly, too, which is advantageous if the drive motor 40, 40' is arranged directly in the flange area 46 between the hollow shafts 44 and 45.

The operation is as follows:

In neutral position the end areas **47'*a*, 47'*b*, 47''*a* and 47''*b* of the partial sections 47' and 47'' of the wrap-around band coupling 47 are in a weak frictional connection with the corresponding parts of the flange area 46, and the hollow shafts 44 and 45. If the flange area 46 is turning in direction of the arrow A1 the end area 47'*a* and the end area 47''*a* are influenced in this direction by which the partial section 47' is contracted because of its direction of winding and by which the partial section 47' is tightened with the flange area 46 and the hollow shaft 44 whilst the partial section 47'' also because of its direction of winding is extended and with exception of the end areas 47''*a* and 47''*b* nearly totally lifted off the flange area 46 and the hollow shaft 45. In this position the wrap-around band coupling 47 allows a transmission of the driving power from the flange area 46 to the hollow shaft 44, whilst the rest of friction between the end areas 47''*a* and 47''*b* is not sufficient to transmit a driving motion from the flange area 46 to the hollow shaft 45. If the flange area 46 is turning in an opposite direction, thus in direction of the arrow A2, the partial section 47' extends and the partial section 47'' contracts. Now the driving motion will be transmitted to the hollow shaft 45**.

It is to be understood that the end areas **47'*a* and 47''*a* of the partial sections 47' and 47'' could be directly connected so that only one wrap-around band coupling 47 exists as shown in FIG. 3**.

FIG. 4 is a diagrammatic view of the drive device according to FIG. 3 in connection with an electric circuit suitable for the device. This circuit diagram shows the line connections of the power supply by switch contacts 52 and 54 to drive motor 40 and by switch contacts 53 or 55 to the electromagnets or discharge valve 12 of FIG. 1. As a drive motor 40, an alternating current synchronous motor which can be driven in reverse in a known way with two windings and three connections, of which a middle connection is applied to one line of the power supply and one of the two other connections, which are bridged by a phase-shifting capacitor, can optionally be connected to the other line of the power supply by switch contacts 52 and 54. Now if, for example, switch contact 54 is operated to prepare a beverage in the direction of the arrow, the connection of drive motor 40 facing this switch contact is directly connected and the opposite motor connection is connected by the capacitor, and drive motor 40 thus is driven so that shaft 45 is driven with cams 50 and 51 and eccentric 34' by wrap-around band coupling 47'. As soon as an actuation in the direction of the arrow is no longer exerted on this switch contact 54, this switch contact 54 is held by cam 50 in the adjusting position, until cam 50 has again reached its initial position. Discharge valve 12—controlled by cam 51—is opened by switch contact 55 for the carbonated water per cam rotation for a period determined by the shape of the cam. The drive lever for the output of the beverage concentrate, driven by eccentric 34', per rotation of shaft 45, at the same time performs a drive movement for the output of a corresponding amount of beverage concentrate.

If switch contact 52 is operated to prepare another beverage in the direction of the arrow, drive motor 40 is applied with its outer connections in reverse direction to the power supply voltage so that motor 40 now rotates in reverse direction and—as already described—drives opposite shaft 44 with cams 48 and 49 and cam 34 by wrap-around band coupling 47″.

Figure 5:
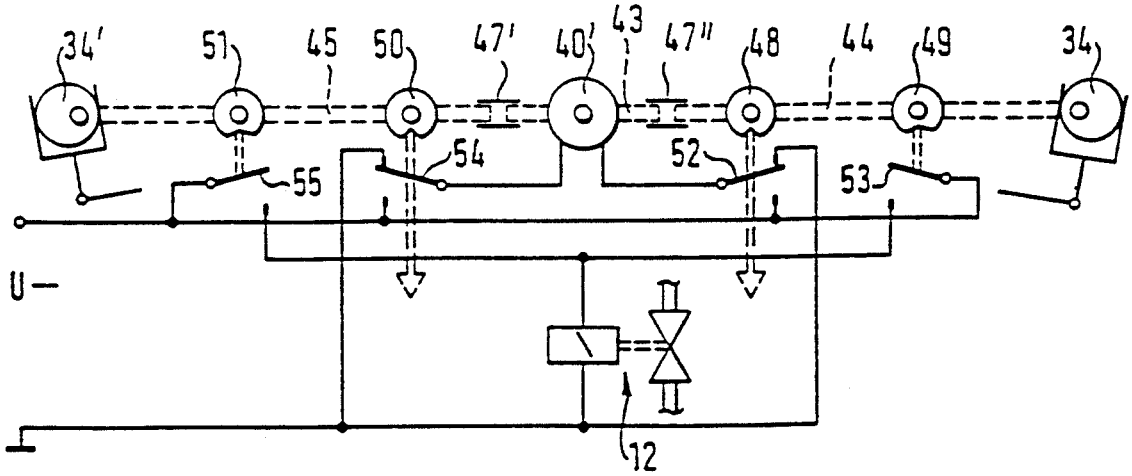
FIG. 5 is an alternative embodiment of the electrical circuit of FIG. 4.

If a direct-current motor 40′ is used, a modified circuit arrangement according to FIG. 5 is recommended, since in this case, the flow of the current also has to be reversed.

Instead of a valve 12, two valves can also be placed which are allocated to the beverage variants and separately to contact circuits 53, 55.

The valve 12 pulses open and closed at each turn of the shaft controlled by the cams. Simultaneously the plunger of the piston pump for the concentrate makes one working cycle.

Figure 7:
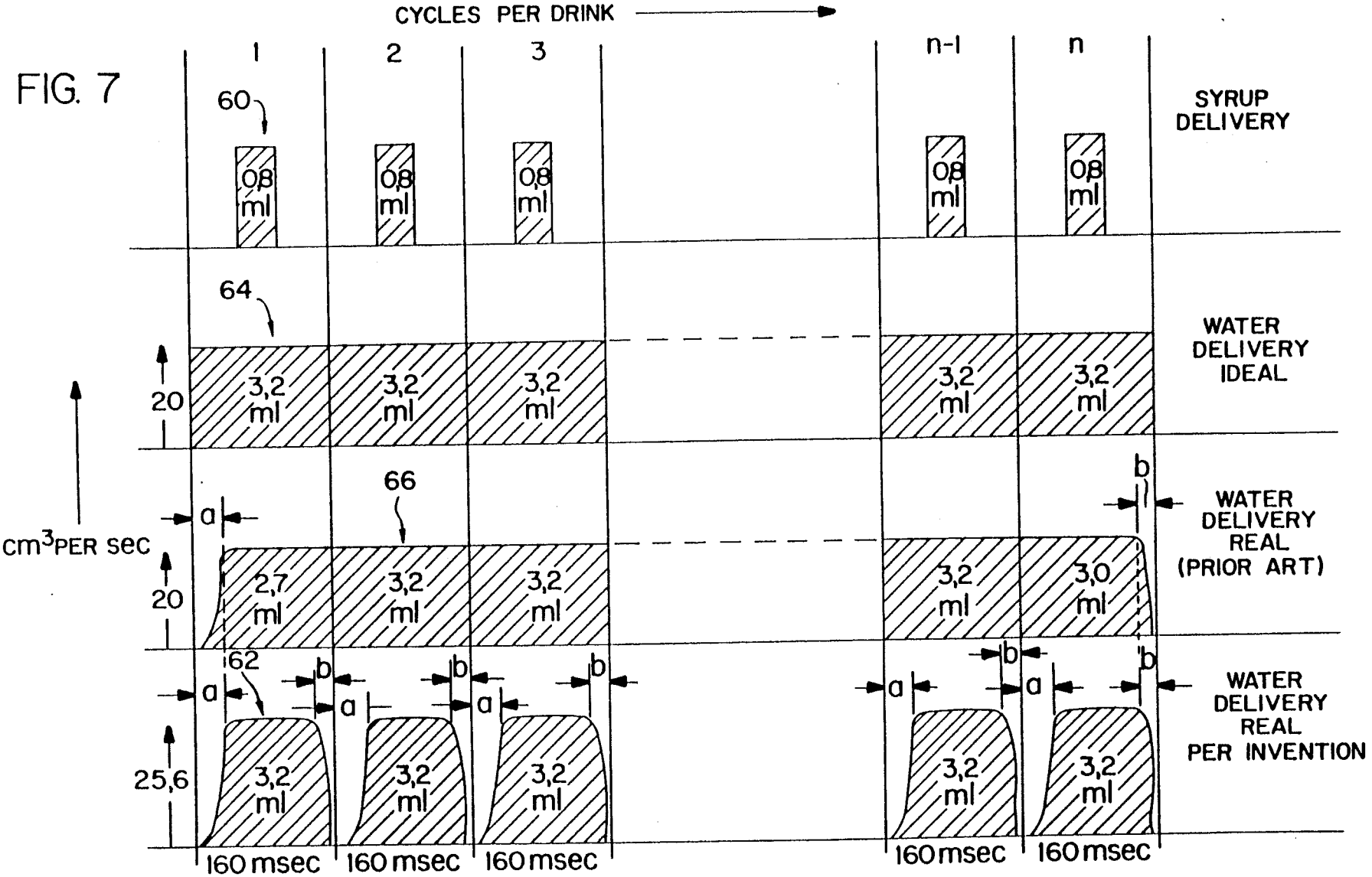
FIG. 7 is a set of pulse type waveforms which are illustrative of the operation of the beverage dispenser of FIG. 1.

Referring now to FIG. 7, it is to be noted that in the subject invention, both the beverage concentrate and the carbonated water are synchronously pulsed during each of n consecutive work cycles during a dispensing time interval as shown by reference numerals 60 and 62, where, for example, 0.8 ml of beverage concentrate and 3.2 ml of concentrated water is delivered during each 160 m sec. work cycle. It is also to be noted that each pulse 62 of carbonated water exhibits a leading edge and a trailing edge during the respective times a and b. This is due to the inherent turn-on and turn-off time of the valve 12.

Where, for example, it is desired to have a 1:4 mix of syrup to carbonated water, if there were no lag time involved in the delivery of carbonated water, one could pulse the syrup concentrate as shown by reference numeral 60 over n consecutive cycles and in effect turn on and turn off the valve 12 at the beginning of the first cycle and at the end of the nth cycle as shown by reference numeral 64 as shown in FIG. 7, where, for example, a delivery.rate of 20 $cm^3$ per sec. is provided by the flow-through regulator 11. However, the ideal does not obtain in actuality and a delivery characteristic as shown by reference numeral 66 in FIG. 7 would result, with only 2.7 ml being delivered during the first work cycle and 3.0 ml being delivered during the last work cycle. This means that less than a 1:4 mix results at the mixing station.

The present invention compensates for this by pulsing the carbonated water during each work cycle as shown by reference numeral 62 by accounting for the a and b discrepancy during each work cycle by increasing the flow rate by means of the manually adjustable regulator 11 to 25.6 $cm^3$ per sec. so that each pulse of carbonated water actually measures 3.2 ml, which is the desired amount equal to the ideal delivery as shown by reference numeral 64. This then provides means of obtaining a more precise and repeatable mixing relationship which can be adjusted and varied on demand.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Apparatus for mixing two liquids in a dispensing system in predetermined proportions at a mixing station, comprising:

a volume dosing piston pump for delivering a relatively smaller portion of a first liquid to said mixing station in a plurality of individual volumetrically controlled pulsed doses of substantially equal volume during a delivery cycle;

a flow regulated time controlled electromagnetic delivery valve having an inherent turn-on and turn-off characteristic and which is flow regulated with respect to volume for synchronously delivering a respective same plurality of relatively larger pulsed doses of substantially equal volume of a second liquid to said mixing station during the same said delivery cycle;

a selectively adjustable flow-through regulator connected to an input side of the delivery valve for controlling the flow rate of said second liquid through said time controlled delivery valve whereby the turn-on and turn-off time of said delivery valve is compensated for during each delivery cycle by selectively varying the flow rate of each said larger dose of second liquid so that a precisely controlled total volume of said second liquid is delivered during each said delivery cycle; and an electromechanical drive mechanism for synchronously controlling the actuation of both the time controlled electromagnetic delivery valve and the volume dosing piston pump to provide a precise and variable control of a predetermined control of a mixed liquid at said mixing station.

2. The apparatus of claim 1 wherein said first liquid comprises a beverage concentrate and said second liquid comprises a diluent.

* * * * *